US008776292B2

(12) United States Patent
Ryan et al.

(10) Patent No.: US 8,776,292 B2
(45) Date of Patent: Jul. 15, 2014

(54) SOUND ENHANCING PILLOW

(76) Inventors: Richard T. Ryan, Stouffville (CA); Paul Regan, Brampton (CA)

( * ) Notice: Subject to any disclaimer, the term of this patent is extended or adjusted under 35 U.S.C. 154(b) by 0 days.

(21) Appl. No.: 13/065,002

(22) Filed: Mar. 11, 2011

(65) Prior Publication Data

US 2011/0219547 A1 Sep. 15, 2011

Related U.S. Application Data

(60) Provisional application No. 61/340,354, filed on Mar. 15, 2010.

(51) Int. Cl.
*A47G 9/10* (2006.01)
*A47C 20/02* (2006.01)

(52) U.S. Cl.
USPC ..... 5/652; 5/636; 5/638; 5/724; 5/725; 5/726; 5/904

(58) Field of Classification Search
USPC ..... 5/636, 638, 724–726, 904
See application file for complete search history.

(56) References Cited

U.S. PATENT DOCUMENTS 1,856,324 A * 5/1932 Fensky ..... 181/133
1,935,034 A * 11/1933 Law ..... 5/636
2,810,445 A * 10/1957 Garrido ..... 181/133
2,943,621 A * 7/1960 Phillips et al. ..... 601/57
2,962,731 A * 12/1960 Bounds ..... 5/639
3,141,179 A * 7/1964 McLean ..... 5/642
3,315,282 A * 4/1967 Lowery et al. ..... 5/638
5,682,633 A * 11/1997 Davis ..... 5/636
5,907,876 A * 6/1999 Schwabe ..... 5/646
5,960,494 A * 10/1999 Gilliland et al. ..... 5/638
5,970,546 A 10/1999 Danis
6,128,797 A * 10/2000 Shaffer ..... 5/638
6,230,350 B1 * 5/2001 Goldstein ..... 5/638
6,408,468 B1 * 6/2002 Comfort ..... 5/636
6,745,418 B1 * 6/2004 Turner, Jr. ..... 5/638
7,469,435 B1 * 12/2008 Cullifer ..... 5/636
7,805,787 B2 * 10/2010 Wallis ..... 5/641
2009/0217459 A1 * 9/2009 Rudolph ..... 5/706
2010/0205743 A1 * 8/2010 Harges ..... 5/638

* cited by examiner

*Primary Examiner* — Robert G Santos
*Assistant Examiner* — Ifeolu Adeboyejo

(57) ABSTRACT

A pillow having a resilient pillow body with a sound transmitting passageway extending through the pillow to bring sound from outside the pillow through an inlet in the side of the pillow to an outlet in the central area of the top of the pillow so that a person using the pillow, with his ear on the outlet, can hear the sound. The passageway has an inlet section leading from the inlet into the pillow which section forms an exponential acoustic horn to amplify and clarify the sound transmitted by the passageway.

20 Claims, 2 Drawing Sheets

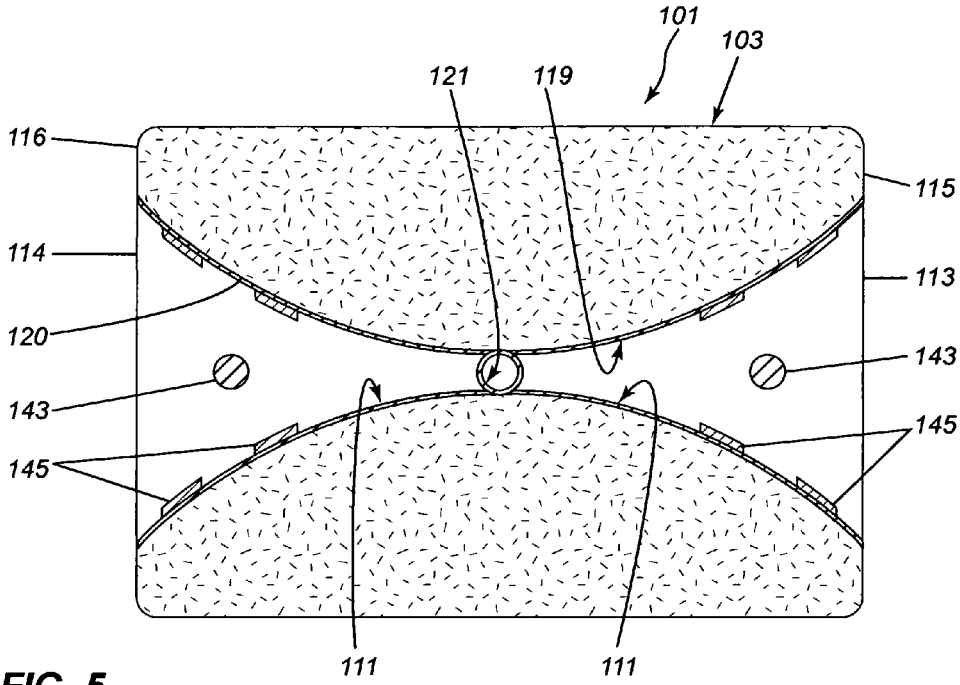
FIG. 5
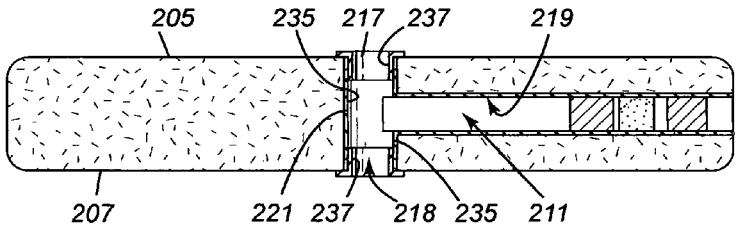
FIG. 6
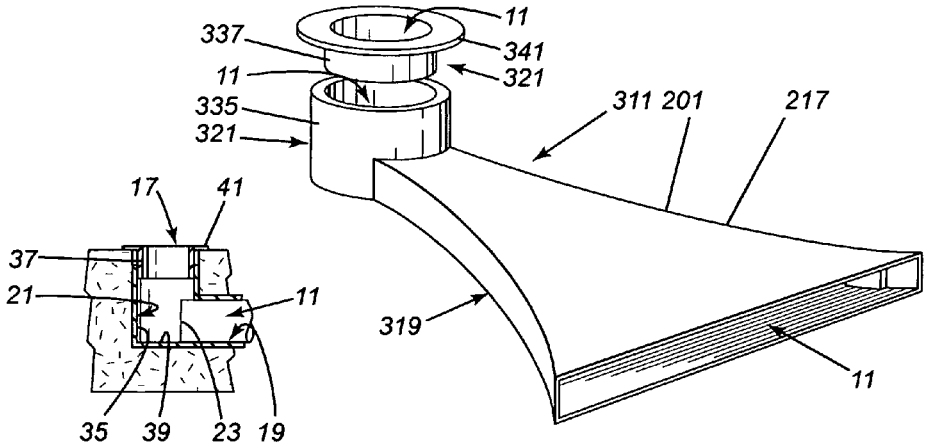
FIG. 4
FIG. 7

SOUND ENHANCING PILLOW

BACKGROUND OF THE INVENTION

1. Technical Field

This invention is directed toward a pillow. The invention is more particularly directed toward a pillow constructed to allow a person to hear sound through both ears while lying with his head on the pillow, the head positioned to have one ear against the pillow.

2. Background Art

A person normally lying down with one side of his head against a pillow has his hearing, through the ear against the pillow, reduced. The sound passing through a pillow can be typically attenuated by about 20 decibels in the lower frequency range below 1000 Hz and by about 25-30 decibels above 1000 Hz. The reduced audibility presents a problem, particularly for people with hearing loss, in being able to hear speech or music or more importantly, warning and signalling sounds such as telephone rings or fire and carbon dioxide alarms.

SUMMARY OF THE INVENTION

It is the purpose of the present invention to provide a pillow constructed to conduct sound from outside the pillow through the pillow to an ear of a person lying with his head on one side on the pillow. It is a more particular purpose of the present invention to provide a pillow that conducts sound to the ear which sound is enhanced both in quality and intensity by the pillow.

In accordance with the present invention, a pillow is provided having top and bottom surfaces joined by a side surface, with an air inlet in the side surface of the pillow, an air outlet in the central area of the top surface of the pillow, and a through passageway joining the inlet and outlets. The through passageway has an inlet section extending from the inlet to the central portion of the pillow. The inlet section is generally horizontal when the pillow is resting on its bottom surface and generally centered in a vertical direction in the pillow. An outlet section extends from the inlet section in the central portion of the pillow up to the outlet. The inlet section is flattened in the vertical direction and shaped as an exponential horn between the inlet and the outlet section. The inlet section, at least, is defined by generally rigid, smooth, walls. The outlet section is tubular in shape and preferably also has a generally rigid, smooth, wall.

The through passageway, being open all the way through, allows sound to enter the ear on the pillow with little attenuation. Thus the loss in hearing, in the ear on the pillow, normally occurring with a regular pillow, is substantially recovered using a through passageway. Using an inlet section in the passageway with an exponential horn shape that gradually narrows toward the outlet section of the passageway, enhances the mid and higher frequencies of the sound while amplifying the sound thus improving both its quality and intensity for the listener.

The invention is particularly directed toward a pillow comprising a pillow body of resilient, cushioning, material having top and bottom surfaces joined by a side surface, the top and bottom surfaces generally parallel. A sound transmitting passageway extends through the pillow body from an inlet in the side surface of the body to an outlet in the top surface of the body. The passageway has an inlet passageway section, leading from the inlet to the central portion of the pillow body, the inlet section shaped to provide an exponential horn that amplifies the sound passing through the passageway.

DESCRIPTION OF SEVERAL VIEWS OF THE DRAWINGS

FIG. 4 is a detail, vertical, cross-section view of the middle of the pillow;

FIG. 5 is a view similar to FIG. 3 showing another embodiment of the pillow;

FIG. 6 is a view similar to FIG. 2 showing another embodiment of the invention: and FIG. 7 is a perspective view of a molded passageway member.

DETAILED DESCRIPTION OF THE INVENTION

Figure 1:
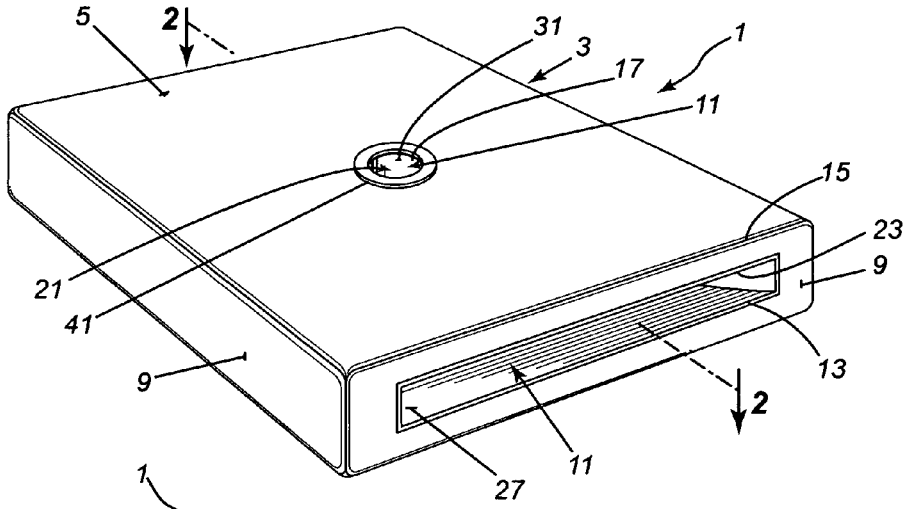
FIG. 1 is a perspective view of the pillow.

The pillow 1 of the present invention, as shown in FIGS. 1-4, is defined by a body 3 of suitable resilient, cushioning, material such as a thermoplastic foam. The pillow body 3 has main surfaces 5, 7, joined by a side surface 9. The pillow body 3 has a generally rectangular shape when viewed from the top but can have other shapes as well. The pillow body 3 has its shape gently rounded, particularly at its edges to more closely imitate a pillow shape and to facilitate the use of a pillow cover (not shown). The pillow 1 is normally symmetrical and can therefore obviously be used with either surface 5, 7 as the top surface. For this description, the surface 5 will be designated as the top surface.

The pillow 1 has a sound transmitting passageway 11 extending through the pillow body 3 from an inlet 13 in the central portion of one end 15 of the pillow body to an outlet 17 in the top surface 5 of the pillow body. The outlet 17 is preferably in the central portion of the top surface 5. The inlet 13 is quite large compared to the outlet 17. The passageway 11 comprises an inlet section 19 extending from the inlet 13 to the central, interior, portion of pillow body 3 and an outlet section 21 extending from the inner end 23 of the inlet section 19 up to the outlet 17.

The inlet section 19 is preferably located midway between the top and bottom surfaces 5, 7 of the pillow body 3. The inlet section 19 is flattened in the vertical direction, preferably of uniform thickness, and exponentially increases in width from its inner end 23 to the inlet 13 forming an exponential horn. The inlet section 19 has top and bottom walls 25, 27 which are preferably parallel, the top and bottom walls 25, 27 joined by side walls 29, 31 which flare outwardly from the inner end 23 toward the inlet 13.

Figure 2:
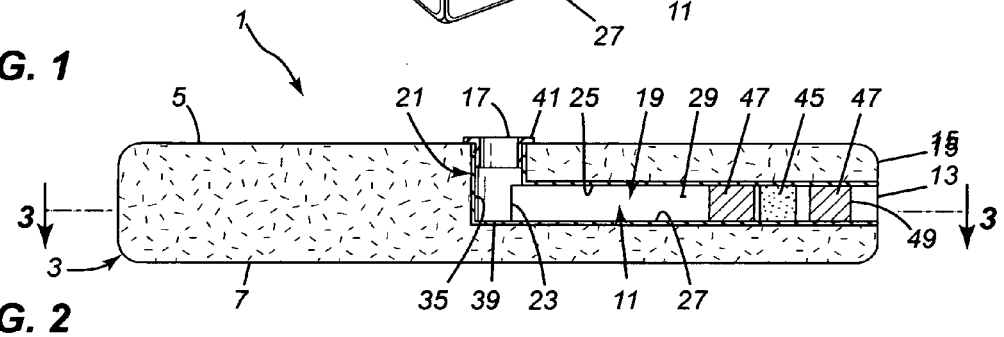
FIG. 2 is a vertical cross-section view of the pillow taken along line 2-2 in FIG. 1.
Figure 3:
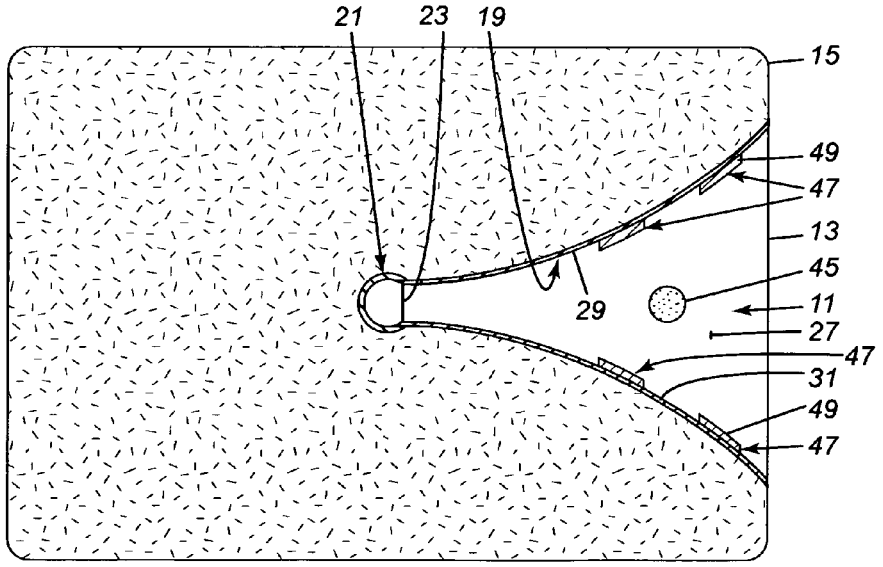
FIG. 3 is a cross-section view of the pillow taken along line 3-3 in FIG. 2.

The outlet section 21 is tubular, preferably cylindrical, and can be shortened in length during use. The outlet section 21 can, as shown in FIGS. 2 and 4, comprise a lower, tubular, wall portion 35 and an upper, tubular, wall portion 37 that slidably fits snugly within the lower wall portion 35. The lower wall portion 35 merges at its lower end 39 with the inner end 23 of the inlet section 19. The upper wall portion 37 has a thin, flexible, annular collar 41 at its upper end. The collar 41 is attached to the top surface 5 of the pillow body and surrounds the outlet 17 of the passageway 11.

The walls 25, 27, 29 and 31 forming the inlet section 19, and the walls forming the tubular wall portions 35, 37 of the outlet section 21, are made of rigid, material and have a generally smooth inner surface defining the passageway 11.

The upper wall portion 37 of the outlet section 21, except for the annular collar 41, is preferably unattached to the pillow body 3.

The inlet section 19 of the passageway 11 can be provided with at least one support 45 extending between the top and bottom walls 25, 27 of the inlet section 19 to prevent the section from collapsing when the pillow is in use. The support 45 is normally located on the longitudinal center line of the inlet section 19 and closer to the inlet 13 than the inner end 23 of the inlet section 19. The support 45 could be in the form of a cylindrical post although other post shapes could be used. The support 45 is normally installed after the inlet section 19 is formed. While only one support 45 is shown, more than one can be employed if necessary.

Baffles 47 are preferably provided in the inlet section 19 of the passageway 11 to dampen out some of the peaks in the frequency response of the sound transmitted. The baffles 47 have acoustic characteristics, and are located in the inlet section 19 in a position, to provide a smooth rising frequency response and thus provide optimal perception of speech and music to the pillow user. The baffles 47 are preferably located on the side walls 29, 31 of the inlet section 19, but can also be mounted on the top and bottom walls 29, 31 and/or on the support 45. The baffles 47 are in the form of patches or areas 49 of sound absorbing, material. The patches 49 can form an integral part of the walls of the inlet section 19 and/or of the support 45; they can be fixedly attached to the walls and/or the supports; or they can be adjustably attached as to their longitudinal position on the walls so as to be able to better control the sound quality. The patches 49 are normally located on the walls nearer the inlet 13 than the inner end 23 of the inlet section 19.

The person using the pillow will place the pillow 1 with the inlet 13 facing in the direction of the source of the sound he wishes to hear and with the top 5 up so he can place his head on the pillow to have one of his ears on the outlet 17. As he places his head on the pillow, compressing it, the outlet section 21 will shorten with its upper portion 37 sliding down into the lower portion 35. The passageway 11 will direct sound to the ear from the inlet 13 in the one end 15 to the outlet 17 in the top 5 and to the ear adjacent the outlet 17. The rigid, generally smooth, wall panels 25, 27, 29 and 31 of the inlet section 19 enhance the sound traveling from the inlet 13 to the outlet 17. The inlet section 19 forms an exponential horn which functions as a wavelength resonator to enhance the sound passing through inlet section 19. More specifically, all frequencies of the sound whose one half wave length are shorter than the length of the inlet section 19 are enhanced. The frequencies enhanced are the higher frequencies. As a result the person whose ear rests on the outlet 17 in the pillow hears the sound transmitted to his ear more clearly. The horn will also noticeably amplify the sound.

The pillow 101, as shown in FIG. 5, can, in another embodiment, be provided with a modified sound transmitting passageway 111 in the pillow body 103. The modified passageway 111 has a first inlet section 119 extending from a first inlet 113 in one end 115 of the pillow body 103 and a second inlet section 120 in the pillow body 103 extending inwardly from a second inlet 114, in the other end 116 of the body, to the outlet section 121. The second inlet section 120 extends from the bottom of the outlet section 121 in a direction opposite to the direction the first inlet section 119 extends from the outlet section 121. The second inlet section 120 is a mirror image of the first inlet section 119, defining an exponential horn, and has the same arrangement of support(s) 143 and baffles 145 as the first inlet section 119. This modified pillow 101, with inlets on both ends of the pillow, could pick up sound effectively from a source on either side of the pillow without having to change the position of the pillow. The second inlet section 120 has the same construction as the first inlet section 119.

In another embodiment, as shown in FIG. 6, the pillow 201 could be provided with a modified sound transmitting passageway 211 having an outlet section 221 that extends all the way through the thickness of the pillow between the top and bottom surfaces 205, 207. Thus either large side of the pillow could be used as the top surface. The through outlet section 221 would have a first outlet 217 one end in one surface 205 and a second outlet 218 at the other end in the other surface 207. One of the outlets 217 or 218 would always be closed by the surface the pillow rests on. The through outlet section 221 would have an inner outlet portion 235 at each end and a separate slidable, outer inlet portion 237 cooperating with each inner outlet portion. While the through outlet section 221 has been shown used with a single inlet section 219, it could also be used with two opposing inlet sections 119, 120 as shown in FIG. 5. A pillow having a sound transmitting passageway having opposed inlet sections 119, 120 connecting to a through outlet section 221 would be the preferred pillow embodiment because then the pillow could be used in any position a pillow is normally used to provide better sound to a person using the pillow.

As shown in FIG. 7, the passageway 11 could be formed by molding an integral passageway member 311 having the inlet section 319 and the lower portion 335 of the outlet section 321. The upper portion 337 of the outlet section 321, with its collar 341, would be molded separately. The pillow body 3 could then be molded about the integral passageway member 311, with the upper portion 337 of the outlet section 321 mounted in the member 311. Alternatively, the pillow body could be molded in two halves with depressions in both halves to receive the inlet section 319 on the member 311 and a bore in the upper half of the body extending part-way down into the lower half to receive the outlet section 321 on the member 311. The two halves are joined with the integral member 311 between them to form the pillow body. The passageways in the other embodiments could be similarly formed.

It may be possible to mold the pillow from resilient material with a hard skin, formed during the molding process from the resilient material, forming any one of the above embodiments of the sound carrying passageway.

While the outlet section of the passageway has been constructed in one manner to make it adjustable in length by using slidably connecting portions, it could be constructed in other ways. The outlet section may, for example, have a corrugated outer end which can compress accordion style to shorten the outlet section. When a person lays his head on the pillow and compresses the pillow, the corrugated outer end of the outlet section would also compress.

The pillow body 3 can be covered with a removable fabric pillow case (not shown). The area of the pillow case over the hole can be modified to replace the pillow case fabric with an open mesh fabric to more easily pass sound if desired.

We claim:

1. A pillow comprising a pillow body of resilient, cushioning, material having top and bottom surfaces joined by an encircling side surface; a sound transmitting passageway extending through the pillow body from a passageway inlet in the side surface of the body to a passageway outlet in the top surface of the body; the passageway having an inlet section, leading from the passageway inlet to terminate in an inlet section outlet, within the pillow body, and an outlet section, generally of the same cross-sectional area as the inlet section outlet, leading from the inlet section outlet to the passageway outlet; the inlet section shaped to provide an exponential horn that expands exponentially from the inlet section outlet to the passageway inlet to clarify and amplify the sound passing through the passageway from the passageway inlet to the outlet section and to the passageway outlet, the clarified and amplified sound able to Pass directly to an ear of a pillow user placed on the top surface of the pillow over the passageway outlet in the top surface of the pillow.

2. A pillow as claimed in claim 1 wherein the outlet section of the passageway is constructed separately from the pillow body so it can be shortened during use.

3. A pillow as claimed in claim 1 wherein the inlet section is flattened, the inlet section extending generally midway between the top and bottom of the pillow body.

4. A pillow as claimed in claim 2 wherein the inlet section is flattened, the inlet section extending generally midway between the top and bottom of the pillow body.

5. A pillow as claimed in claim 2 wherein the walls defining the inlet section are rigid and generally smooth on the inside.

6. A pillow as claimed in claim 4 wherein the walls defining the inlet section are rigid and generally smooth on the inside.

7. A pillow as claimed in claim 2 wherein the outlet section has a lower portion integral with the inlet section, and a separate, upper portion slidable within the lower portion, the upper portion having a flat, flexible collar at its outer end forming the passageway outlet.

8. A pillow as claimed in claim 4 wherein the inlet section has generally parallel top and bottom walls and at least one support member extending between the top and bottom walls in the inlet section to maintain the vertical spacing between the walls when a head of a pillow user rests on the pillow.

9. A pillow as claimed in claim 1 including at least one baffle area in the inlet section, flat against a wall of the inlet section, to smooth the frequency response of the sound passing through the passageway.

10. A pillow as claimed in claim 4 including at least one baffle area in the inlet section, flat against a wall of the inlet section, to smooth the frequency response of the sound passing through the passageway.

11. A pillow as claimed in 2 including a rigid integral member mounted within the pillow body, the member having a first rigid wall section forming the inlet section.

12. A pillow as claimed in claim 11 wherein the rigid integral member has a second rigid wall section extending from the first rigid wall section forming a lower wall portion of the outlet section.

13. A pillow as. claimed in claim 12 including a separate, upper wall portion slidable into the lower wall portion of the outlet section to form the upper part of the outlet section.

14. A pillow as claimed in claim 13 including a flat, flexible collar at the outer end of the upper wall portion, the collar defining the outlet of the passageway and adapted to be attached to the top surface of the body.

15. A pillow as claimed in claim 1 including a second inlet passageway section in the pillow body extending from the outlet section, in a direction opposite to the first inlet section, to a second inlet in the side surface of the pillow body opposite to the first inlet, the second inlet section aligned with the first inlet section and a mirror image of it.

16. A pillow as claimed in claim 2 including a second inlet passageway section in the pillow body extending from the outlet section, in a direction opposite to the first inlet section, to a second inlet in the side surface of the pillow body opposite to the first inlet, the second inlet section aligned with the first inlet section and a mirror image of it.

17. A pillow as claimed in claim 1 wherein the outlet section extends between the top and bottom surfaces of the pillow body, the outlet section having a passageway outlet at each end.

18. A pillow as claimed in claim 15 wherein the outlet section extends between the top and bottom surfaces of the pillow body, the outlet Section having a passageway outlet at each end.

19. A pillow as claimed in claim 17 wherein the outlet section of the passageway is constructed separately from the pillow body so it can be shortened during use.

20. A pillow as claimed in claim 18 wherein the outlet section of the passageway is constructed separately from the pillow body so it can be shortened during use.

* * * * *